US011585632B2

(12) United States Patent
Tippmann, Jr.

(10) Patent No.: US 11,585,632 B2
(45) Date of Patent: Feb. 21, 2023

(54) PISTOL ARM BRACE

(71) Applicant: Tippmann Arms Company, LLC, Fort Wayne, IN (US)

(72) Inventor: Dennis J. Tippmann, Jr., Fort Wayne, IN (US)

(73) Assignee: Tippmann Arms Company, LLC, Fort Wayne, IN (US)

( * ) Notice: Subject to any disclaimer, the term of this patent is extended or adjusted under 35 U.S.C. 154(b) by 0 days.

(21) Appl. No.: 17/103,086

(22) Filed: Nov. 24, 2020

(65) Prior Publication Data

US 2021/0172703 A1 Jun. 10, 2021

Related U.S. Application Data

(60) Provisional application No. 62/944,768, filed on Dec. 6, 2019.

(51) Int. Cl.
*F41C 23/12* (2006.01)
*F41C 23/14* (2006.01)

(52) U.S. Cl.
CPC ..... *F41C 23/12* (2013.01); *F41C 23/14* (2013.01)

(58) Field of Classification Search
CPC ..... F41C 23/10; F41C 23/12; F41C 23/14; F41C 23/20
See application file for complete search history.

(56) References Cited

U.S. PATENT DOCUMENTS

| | | | | |
|---|---|---|---|---|
| 4,766,800 | A * | 8/1988 | Miller | F41A 17/38 89/33.02 |
| 8,127,483 | B2 * | 3/2012 | Kincel | F41C 23/14 42/73 |
| 8,869,444 | B2 * | 10/2014 | Bosco | F41C 33/001 42/71.01 |
| 9,664,477 | B1 * | 5/2017 | Reavis, III | F41C 23/04 |
| 10,571,219 | B2 * | 2/2020 | Wilson | F41C 23/04 |
| 10,627,189 | B2 * | 4/2020 | Faifer | F41C 23/04 |
| 10,823,528 | B2 * | 11/2020 | Reavis, III | F41C 23/12 |

OTHER PUBLICATIONS

SBPDW 42920 Pistol Stabilizing Brace; Apr. 2020.
SB-MINI 5120 Pistol Stabilizing Brace; Apr. 2020.
SBM4 42920—Pistol Stabilizing Brace; Apr. 2020.
SBA3 42820—Pistol Stabilizing Brace; Apr. 2020.
Maxim CQB Pistol_PDW Brace for AR15—Maxim Defense; Nov. 5, 2020.
Sig Sauer-SBX Pistol Stabilizing Brace; Nov. 5, 2020.

* cited by examiner

*Primary Examiner* — Joshua T Semick
(74) *Attorney, Agent, or Firm* — Barnes & Thornburg LLP

(57) ABSTRACT

A pistol arm brace is provided with a slide portion and a stabilizing structure extending from the slide portion. The slide portion is configured to connect with a receiver extension of a pistol. The stabilizing structure includes a spring-loaded clamping portion configured to secure the stabilizing structure to a user's forearm based on urging of one or more springs in the spring-loaded clamping portion.

11 Claims, 11 Drawing Sheets

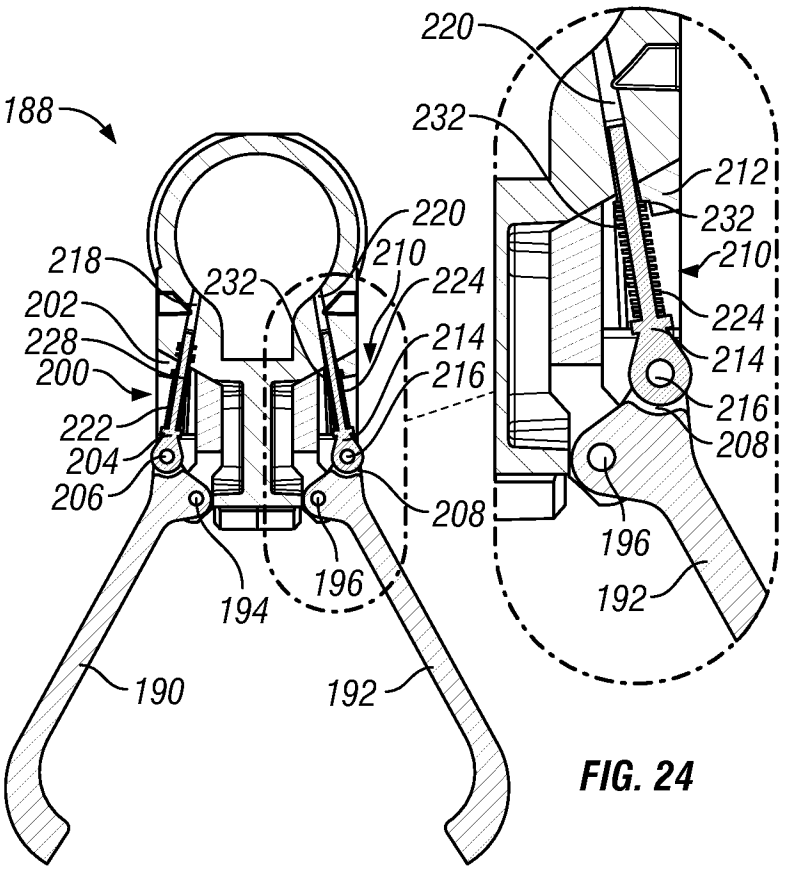
FIG. 21
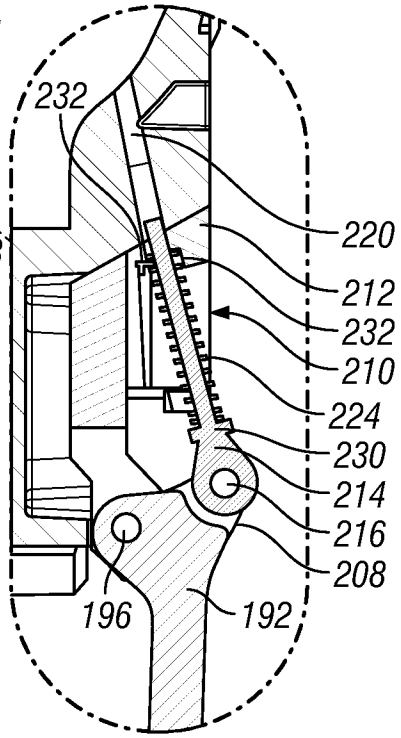
FIG. 22
FIG. 23
FIG. 24

PISTOL ARM BRACE

RELATED APPLICATIONS

This application claims the benefit of U.S. Provisional Application Ser. No. 62/944,768 filed Dec. 6, 2019, which is hereby incorporated by reference in its entirety.

TECHNICAL FIELD

This disclosure relates generally to pistols; in particular, this relates to an arm brace for a pistol to increase stability during single-handed firing.

BACKGROUND

Pistol arm braces are accessories for pistols that stabilize the shooter's forearm during single-handed shooting to increase accuracy and reduce muzzle rise. FIG. 1 illustrates a prior art pistol arm brace 10 that includes a brace body 12 with a slide portion 14 for attaching the brace body 12 to a pistol (not shown). An arm assembly 16 includes a first flexible arm 18 and a second flexible arm 20 that are made from a flexible, rubber-like material. Although the flexible arms 18, 20 are comfortable against the shooter's forearm, the flexible arms 18, 20 are generally flimsy without providing any rigidity or structure for the arms 18, 20. An adjustable strap 22 is wrapped around the slide portion 14 and the arms 18, 22 to increase rigidity.

In the closed position shown in FIG. 1, the strap 22 is pulled tight so the flexible arms 18, 20 are pulled together. During use, the strap 22 would be loosened so that the shooter's forearm can be inserted through the opening 24 and then the strap 22 would be tightened around the shooter's forearm. By tightening the strap 22 around the shooter's forearm, this clamps down the flexible arms 18, 20 around the forearm of the shooter. Since the flexible arms 18, 20 cannot clamp down on the shooter's forearm by themselves, the strap 22 is an essential component of the pistol arm brace 10 shown in FIG. 1 to clamp the arms 18, 22 around the shooter's forearm for stability. Without the strap 22, the flexible arms 18, 20 are too flimsy to clamp down around the shooter's forearm and the brace would merely fall off during use.

Although pistol arm braces, such as shown in FIG. 1, are generally acceptable for their purpose, the strap increases complexity and adjusting the strap during use takes time. Therefore, there is a need for a strapless pistol arm brace.

SUMMARY

According to one aspect, this disclosure provides a pistol arm brace with a slide portion and a stabilizing structure extending from the slide portion. The slide portion is configured to connect with a receiver extension of a pistol. The stabilizing structure includes a spring-loaded clamping portion configured to secure the stabilizing structure to a user's forearm based on urging of one or more springs in the spring-loaded clamping portion.

According to another aspect, this disclosure provides a pistol arm brace with a brace body, a first spring-loaded arm, and a second spring-loaded arm. The brace body includes a slide portion configured to connect with a receiver extension of a pistol. The first spring-loaded arm is connected with the brace body. The second spring-loaded arm is connected with the brace body and opposes the first spring-loaded arm. The first spring-loaded arm and the second spring-loaded arm are movable between an open position and a closed position. In the open position, the first spring-loaded arm and the second spring-loaded arm are urged towards each other to clamp down on a user's forearm.

According to a further aspect, this disclosure provides a pistol arm brace with a slide portion and a stabilizing structure. The slide portion is configured to connect with a receiver extension of a pistol. The stabilizing structure extends from the slide portion. The stabilizing structure includes strapless means for securing the stabilizing structure to a user's forearm.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

FIG. 21 is a rear cross-sectional view of the example arm brace shown in FIG. 20 along line 21-21;

FIG. 22 is a detailed view of the arm brace shown in FIG. 21 illustrating the compression spring positioning with the arms in the storage position;

FIG. 23 is a rear cross-sectional view of the example arm brace shown in FIG. 21 with the arms in an extended position similar to that in FIG. 19 to receive a shooter's forearm; and FIG. 24 is a detailed view of the arm brace shown in FIG. 23 illustrating the compression spring positioning with the arms in the extended position to receive a shooter's forearm.

DETAILED DESCRIPTION OF THE DRAWINGS

Figure 1:
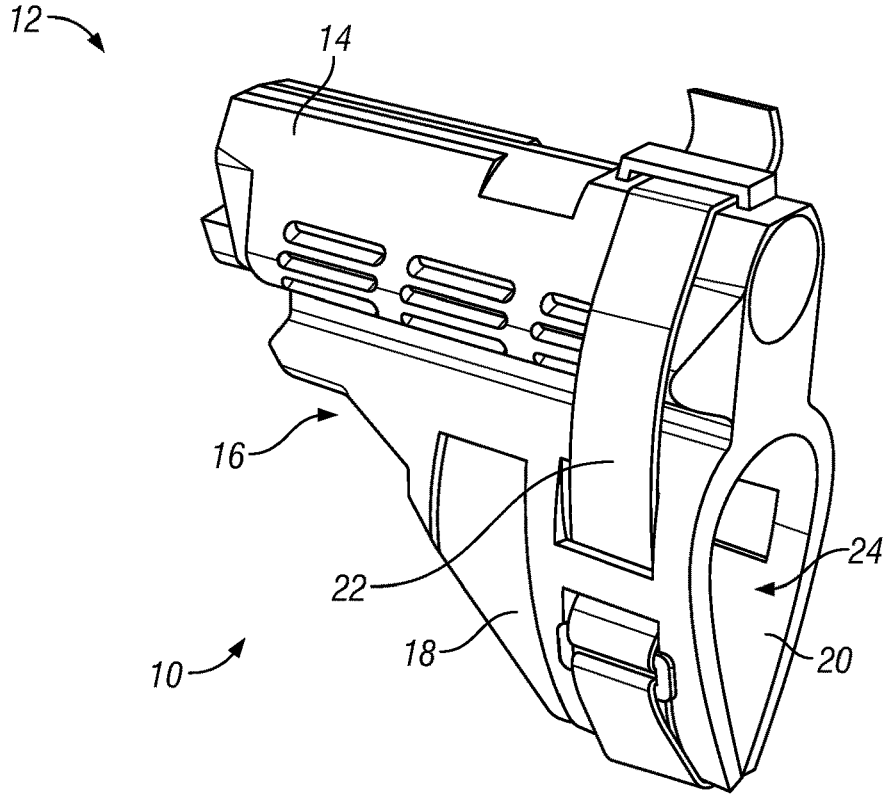
FIG. 1 (Prior Art)
FIG. 1 is a perspective view of a prior art pistol arm brace.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural features may be shown in specific arrangements. However, it should be appreciated that such specific arrangements may not be required. Rather, in some embodiments, such features may be arranged in a different manner than shown in the illustrative figures. Additionally, the inclusion of a structural in a particular figure is not meant to imply that such feature is required in all embodiments and, in some embodiments, may not be included or may be combined with other features.

This disclosure relates generally to a strapless pistol arm brace. Instead of using a strap like the pistol arm brace shown in FIG. 1, embodiments of the pistol arm brace disclosed herein include spring-loaded stabilizing arms that clamp down on the shooter's forearm during use. This eliminates the need for a strap to stabilize flexible arms.

Figure 2:
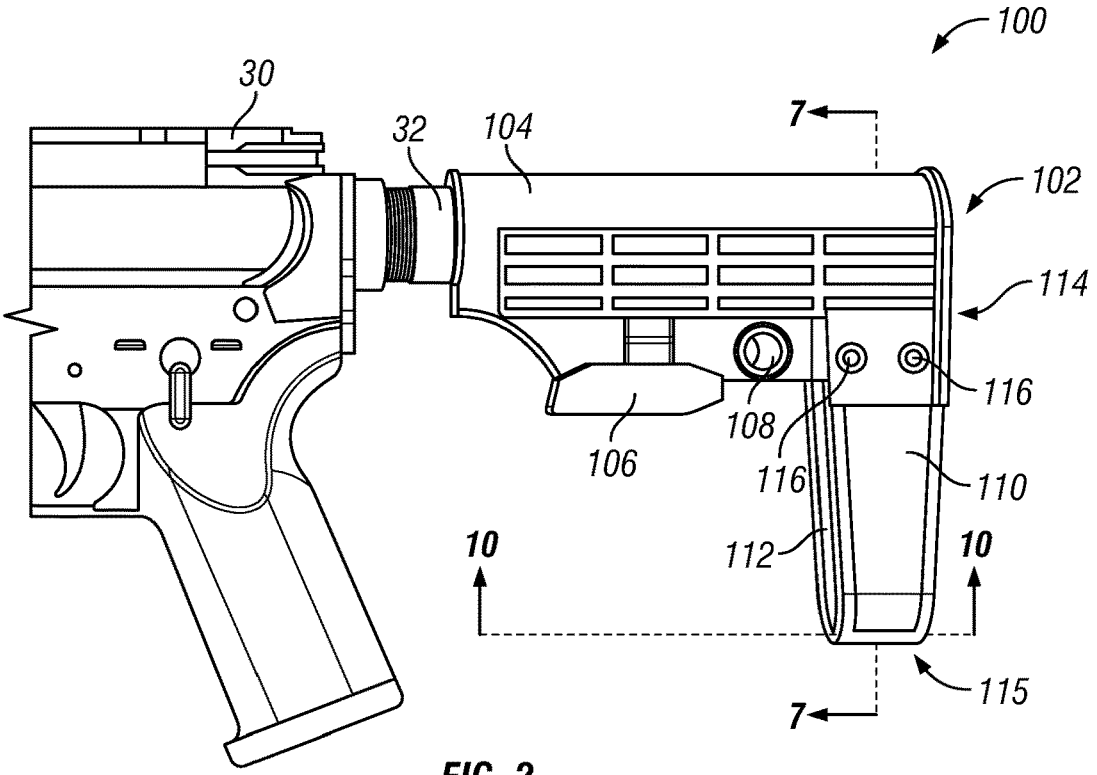
FIG. 2 is a left side view of an example pistol arm brace according to an embodiment of this disclosure connected with a pistol.

FIG. 2 shows an example pistol arm brace 100 according to an embodiment of this disclosure. As shown, there is a pistol 30 that includes a receiver extension 32, such as a buffer tube, to which the pistol arm brace 100 may be connected. The pistol arm brace 100 could be connected with any of a variety of pistols. By way of example only, the pistol arm brace 100 may be configured for connection with standard Pistol Receiver Extensions.

In the embodiment shown, the pistol arm brace 100 includes a brace body 102 with a slide portion 104 that is configured to receive a portion of the receiver extension 32. For example, the slide portion 104 may include a longitudinally extending cavity to receive at least a portion of the receiver extension 32. The position of the pistol arm brace 100 may be adjustable with respect to the pistol 30. For example, the pistol arm brace 100 may include an adjustment lever 106 that can be actuated to adjust the position of the pistol arm brace 100 with respect to the pistol 30. Upon actuating the adjustment lever 106, the brace body 102 may be slidable forward towards the pistol 30 or rearward away from the pistol 30. Upon releasing the adjustment lever 106, the brace body 102 locks into the selected position. As shown, the brace body 102 includes an opening 108.

As shown, the pistol arm brace 100 includes a first spring-loaded stabilizing arm 110 and a second spring-loaded stabilizing arm 112. In the embodiment shown, the first spring-loaded stabilizing arm 110 includes a proximal end 114 connected with the brace body 102 and a distal end 115 extending away from the brace body 102. As shown, the proximal end 114 of the stabilizing arm 110 is connected to the brace body 102 with one or more fasteners 116. As explained herein, in some embodiments the fasteners 116 extend through both the first spring-loaded stabilizing arm 110 and the second spring-loaded stabilizing arm 112.

Figure 5:
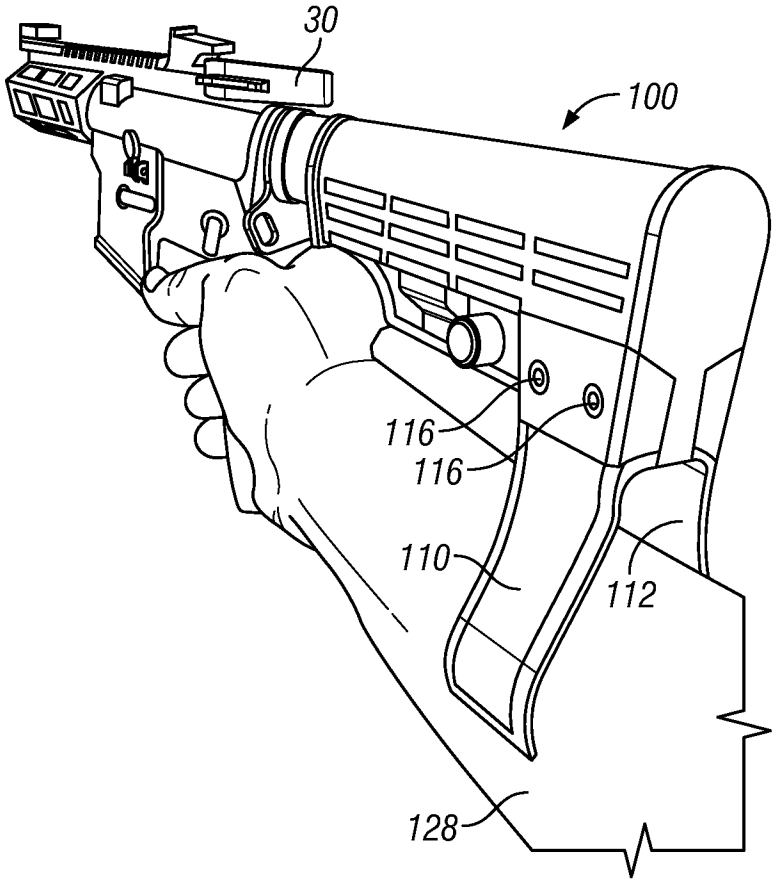
FIG. 5 is a left side perspective view of the example arm brace shown in FIG. 2 gripping a forearm of a shooter.
Figure 4:
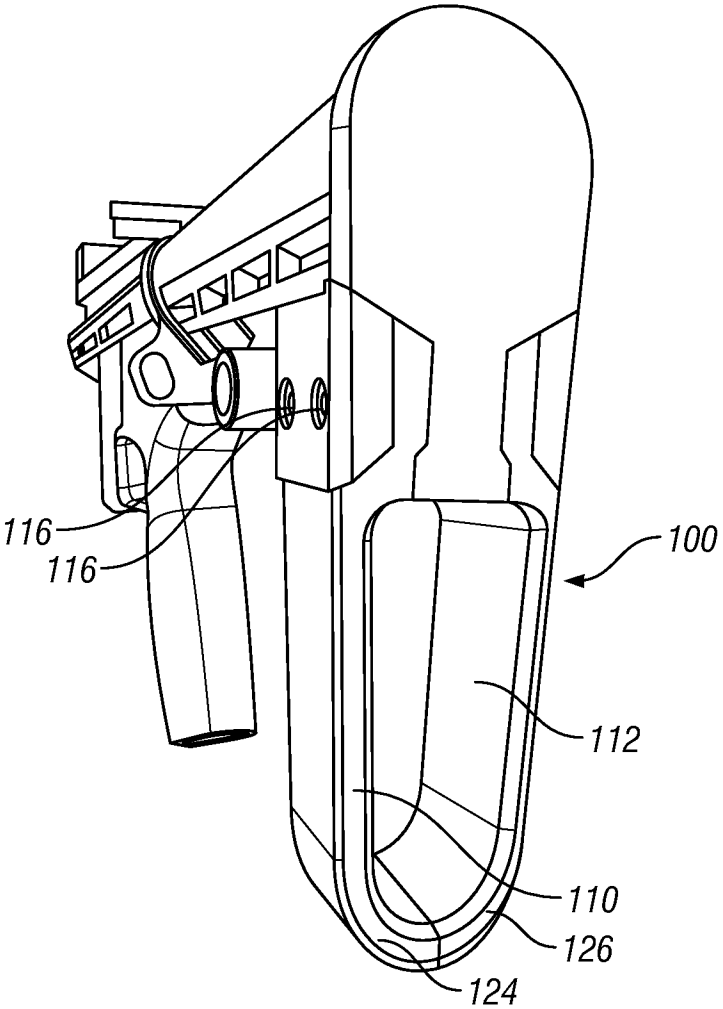
FIG. 4 is a rear perspective view of the example pistol arm brace shown in FIG. 2 in the storage position.

As explained herein, the spring-loaded arms 110, 112 are urged towards each other (i.e., towards the closed position shown in FIG. 4). A shooter may apply enough force to overcome the urging of the springs to separate the arms 110, 112, and insert the shooter's forearm therebetween as shown in FIG. 5. With the shooter's forearm between the arms 110, 112, the spring-loaded arms 110, 112 are under tension and clamp onto the shooter's forearm to provide stability during shooting. When the shooter removes his/her forearm, the springs continue to urge the arms 110, 112 toward each other and move back into the closed position (FIG. 4).

Figure 3:
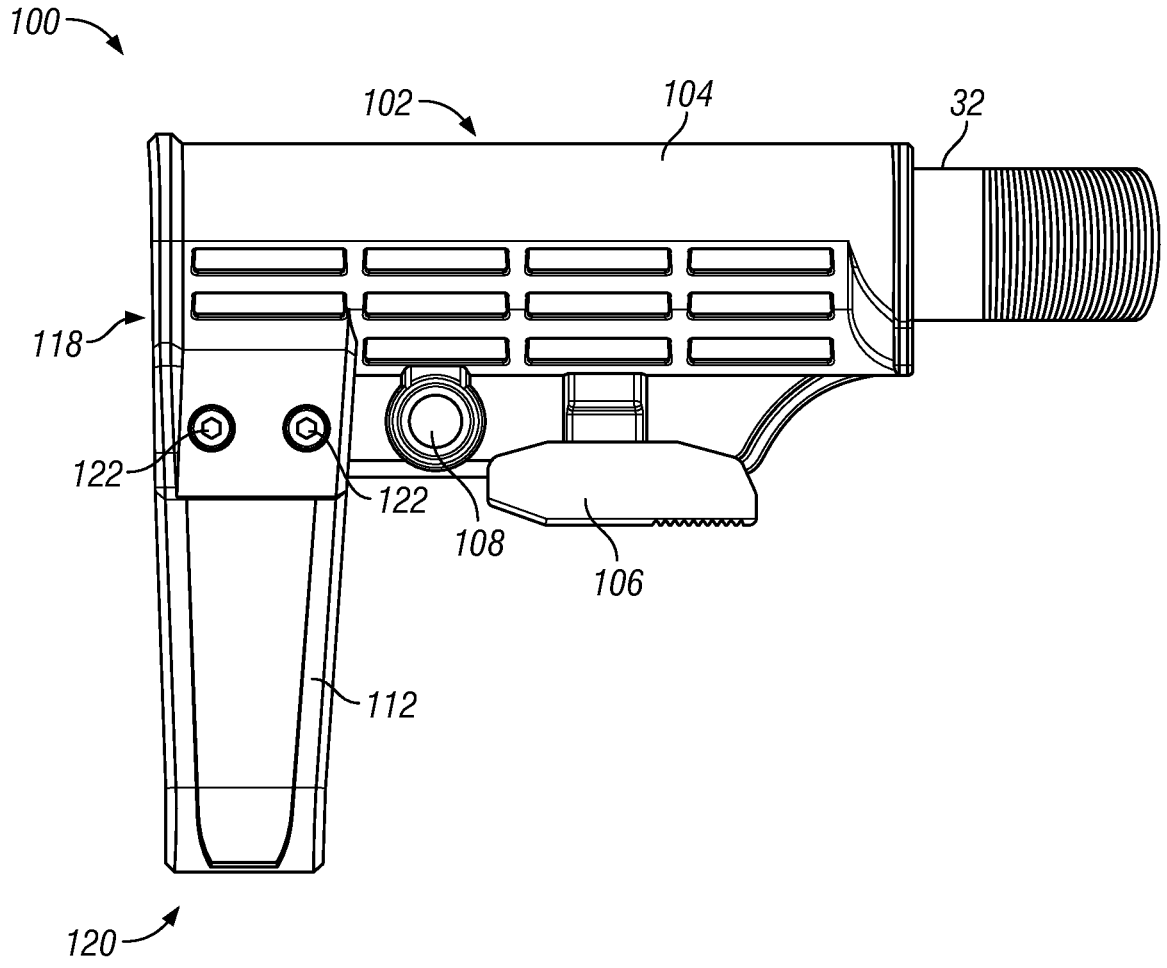
FIG. 3 is a right side view of the example pistol arm brace shown in FIG. 2 disconnected from the pistol.

FIG. 3 shows the pistol arm brace 100 from the right side and the second spring-loaded stabilizing arm 112 can be better seen. In the embodiment shown, the second spring-loaded stabilizing arm 112 includes a proximal end 118 connected with the brace body 102 and a distal end 120 extending away from the brace body 102. As shown, the proximal end 118 of the stabilizing arm 112 is connected to the brace body 102 with one or more fasteners 122. As explained herein, in some embodiments the fasteners 122 cooperate with fasteners 116 to connect the second spring-loaded stabilizing arm 112 to the brace body 102. By way of example, the fasteners 116 may be bolts that extend through both the first and second stabilizer arms 110, 112, and the fasteners 122 are nuts that receive the bolts.

FIG. 4 shows the pistol arm brace 100 in the closed position. As shown, the spring-loaded arms 110, 112 are urged together towards the closed position so their respective distal ends 115, 120 come together to form a substantially uninterrupted surface. As shown, the first spring-loaded arm 110 includes a curved portion 124 and the second spring-loaded arm 112 includes a curved portion 126 that corresponds with the curvature of the curved portion 124.

FIG. 5 shows the pistol arm brace 100 in an open position after the shooter has applied a force to overcome the urging of spring-loaded arms 110, 112 and separate the arms 110, 112 to insert his/her forearm 128 therethrough. As shown, the spring-loaded arms 110, 112 clamp down on the shooter's forearm 128 due to urging of spring-loaded arms 110, 112 towards each other. When the shooter removes his/her forearm from the pistol arm brace 100, the spring-loaded arms 110, 112 will be urged back together to the closed position shown in FIG. 4.

Figure 6:
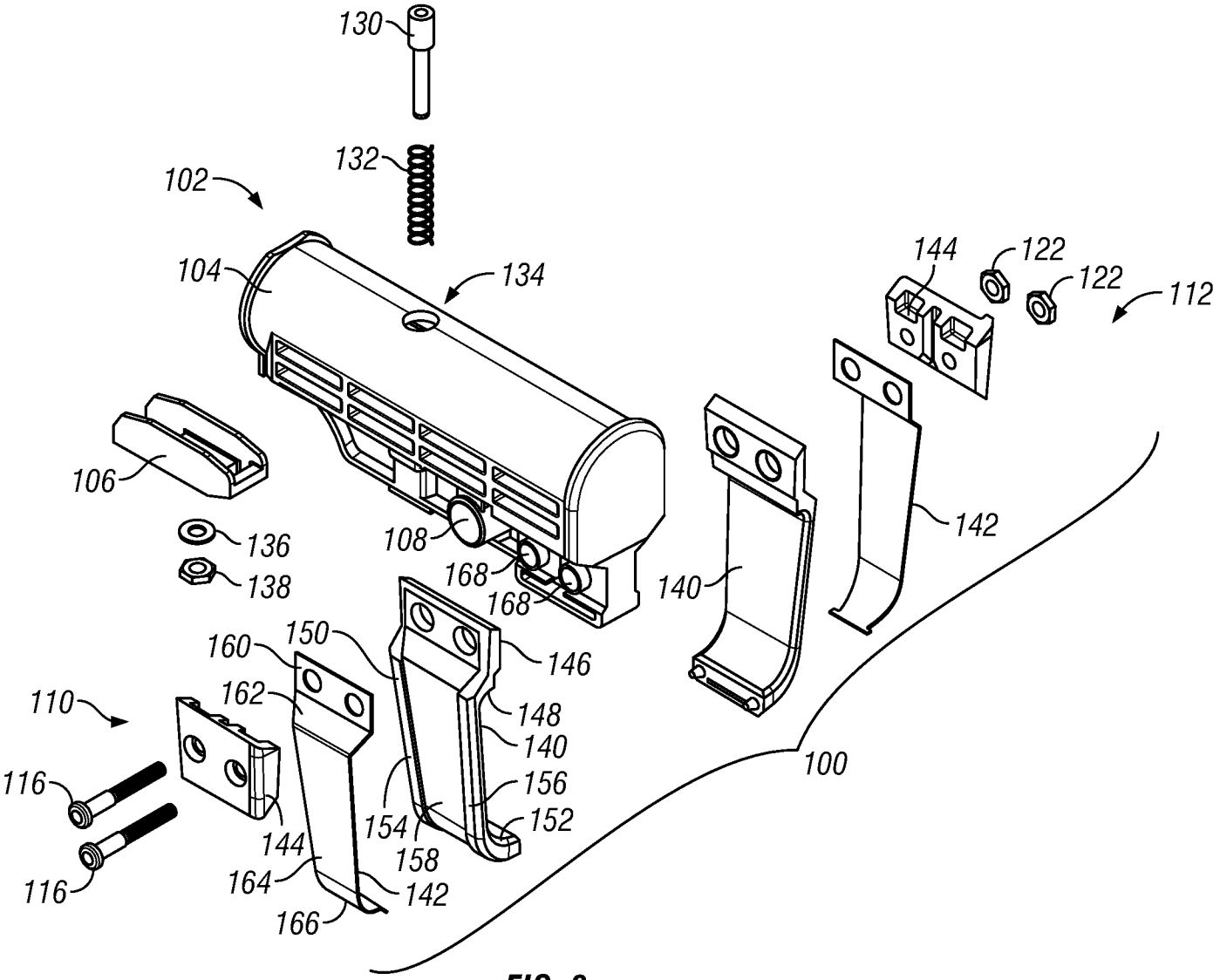
FIG. 6 is an exploded view of the example pistol arm brace shown in FIG. 2.

FIG. 6 is an exploded view showing components of the example pistol arm brace 100. As shown, there is shown a telescoping location adjustment pin 130 that extends through a spring 132, and is received through an opening 134 in the brace body 102. The adjustment pin 130 extends through the adjustment lever 106 and washer 136 and connects with a nut 138. As discussed herein, the pistol arm brace 100 is slidable with respect to the pistol 30 by actuating the adjustment lever 106, which allows adjustment pin 130 to telescope in/out of openings (not shown) in the receiver extension 32 to select a desired position of the brace body 102.

In the example shown, the first spring-loaded arm 110 and second spring-loaded arm 112 include a flexible arm 140, a flat spring 142, and an arm cover 144. The flexible arm 140 may be formed from a flexible material, such as rubber, silicon, etc. The flat spring 142 may be formed from a resilient material, such as a stainless steel flat spring, which provides structure to the flexible arm 140 and urges the flexible arm 140 toward the closed position. Although this example illustrates a separate flat spring 142 that is connected with a flexible arm 140, embodiments are contemplated in which the flat spring 142 and flexible arm 140 could be formed from a unitary member. For example, the spring-loaded arms 110, 112 could be formed from a unitary member with material characteristics that has a soft feel on the user's forearm and a sufficient spring force to clamp onto the user's forearm during firing. For example, the spring-loaded arms 110, 112 could be unitary members formed from an elastomeric material that is soft to the touch, and can be deflected sufficiently to receive the user's forearm, but has sufficient spring force to clamp down on the user's forearm.

In the example shown, the flexible arm 140 includes a flange portion 146, an angled portion 148, a flat portion 150, and a curved portion 152. As shown, the flexible arm 140 includes a first lip 154 and a second lip 156 that extend longitudinally to define a recessed area 158 therebetween. The recessed area 158 is dimensioned to receive the flat spring 142. The flat spring 142 includes a flange portion 160, an angled portion 162, a flat portion 164, and a curved portion 166 corresponding with the flange portion 146, the angled portion 148, the flat portion 150, and the curved portion 152 of the flexible arm 140. The arm cover 144 includes angled walls corresponding to the angled portion 162 of the flat spring 142 and the brace body 102.

As shown, the brace body 102 includes openings 168 to receive fasteners 116, which could be embodied as bolts that extend transversely through the brace body 102. The arm cover 144, flat spring 142, and flexible arm 140 includes openings are aligned with each other, and with openings 168 in the brace body 102 so the fasteners 116 extend through both the first spring-loaded arm 110 and the second spring-loaded arm 112. As shown, the fasteners 122 may be embodied as nuts that receive ends of the fasteners 116. With the fasteners 116, 122 connected, the proximal ends 114, 118 of the first spring-loaded arm 110 and the second spring-loaded arm 112 are connected together to opposite sides of the brace body 102.

Figure 7:
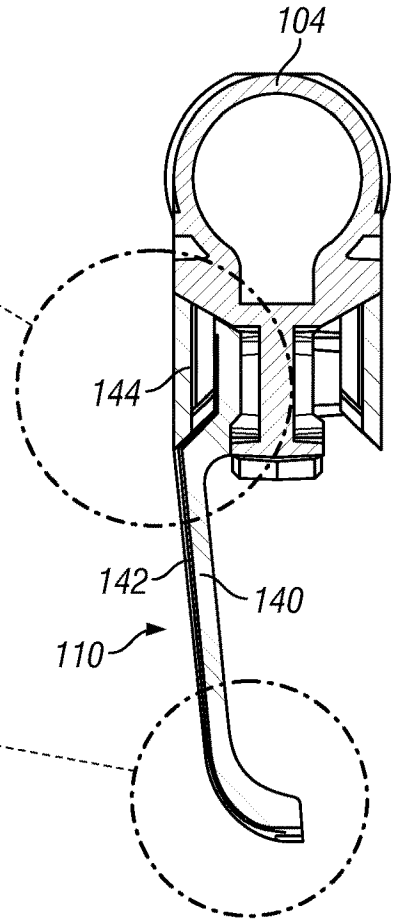
FIG. 7 is a rear cross-sectional view of the example arm brace shown in FIG. 2 along the line 7-7.
Figure 8:
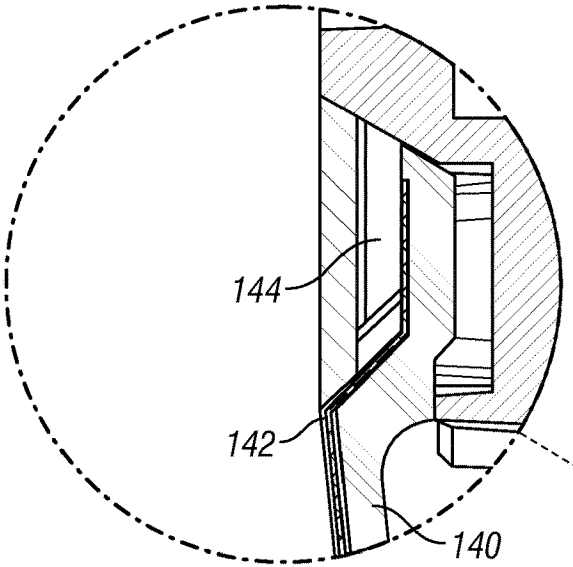
FIG. 8 is a detailed view of the connection between the arm, arm cover and upper portion of the spring shown in FIG. 7.
Figure 9:
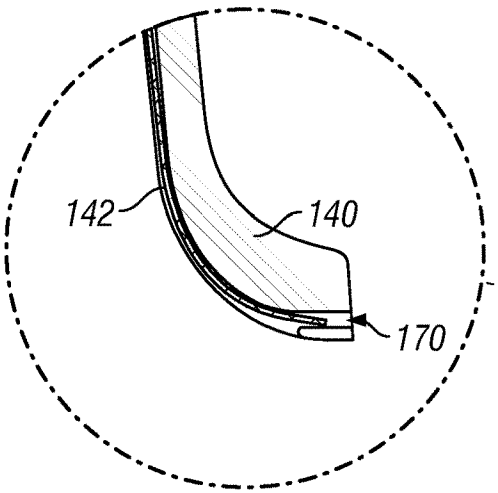
FIG. 9 is a detailed view of a distal end of an arm showing termination of the spring.
Figure 13:
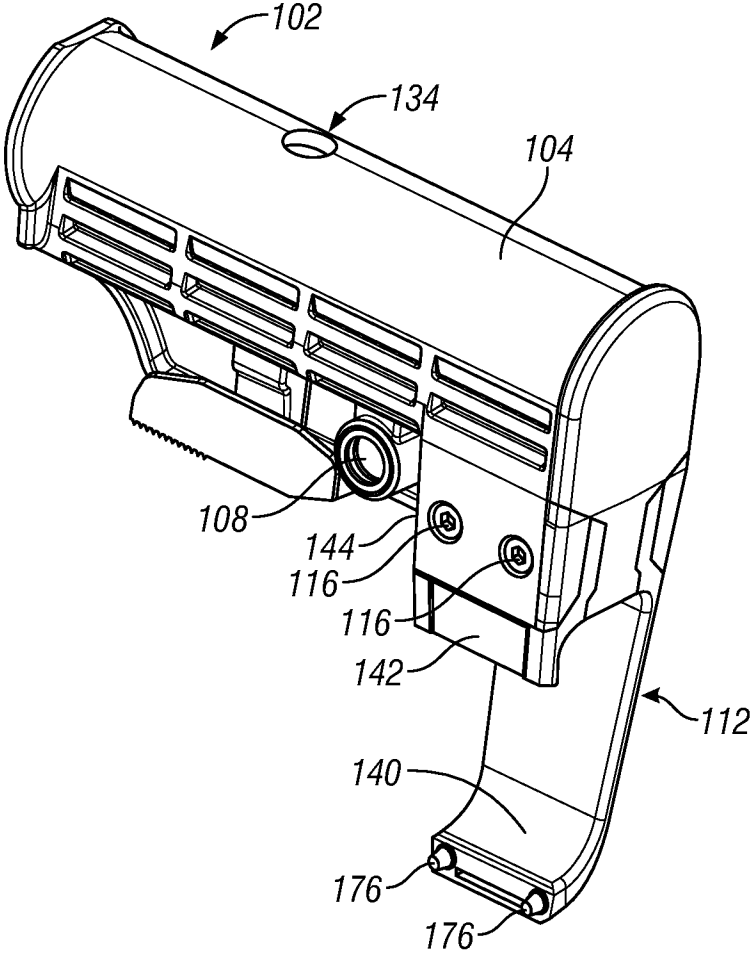
FIG. 13 is a left side perspective view of the example arm brace shown in FIG. 2 with a portion of the first arm removed.
Figure 12:
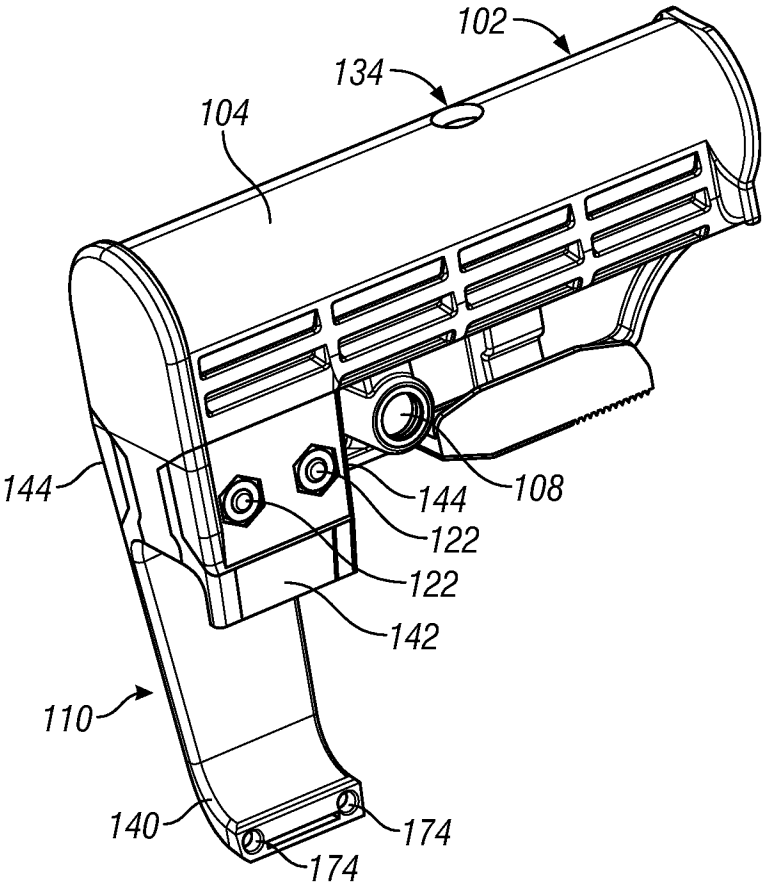
FIG. 12 is a right side perspective view of the example arm brace shown in FIG. 2 with a portion of the second arm removed.
Figure 14:
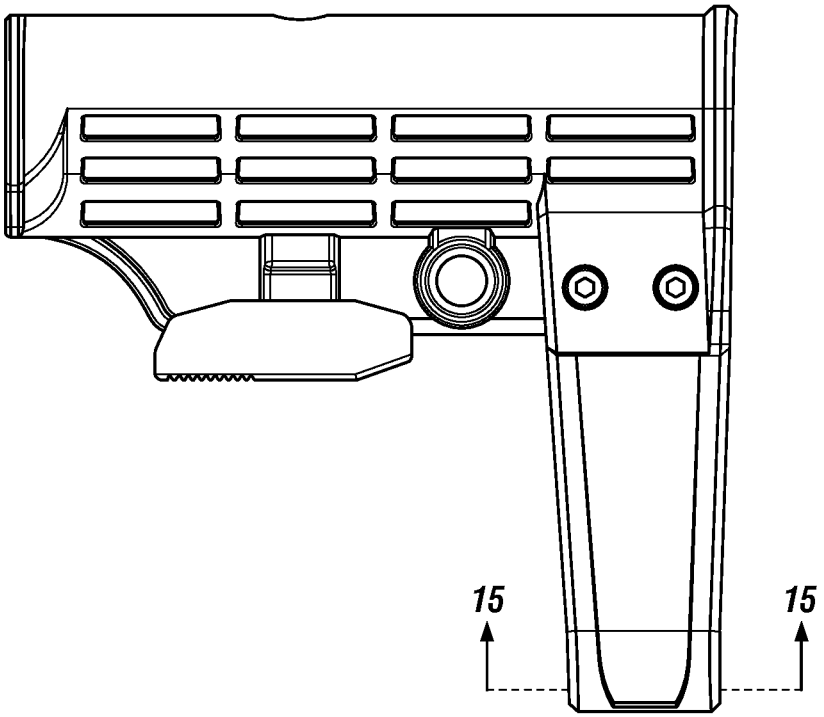
FIG. 14 is a left side view of the example arm brace shown in FIG. 2.
Figure 15:
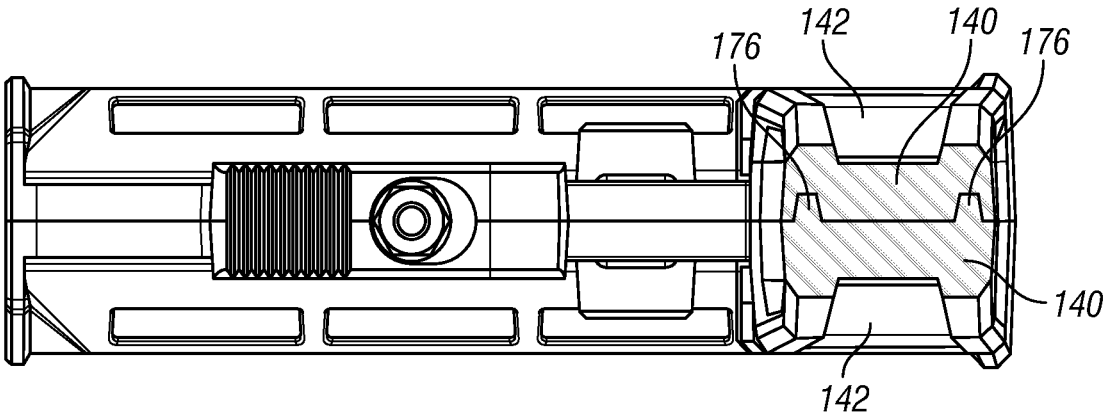
FIG. 15 is a bottom cross-sectional view of the example arm brace shown in FIG. 14 along line 15-15.

Referring now to FIGS. 7-9, there is shown a rear cross-sectional view showing the first spring-loaded arm 110 with the second spring-loaded arm 112 removed. From this view, the flat spring 142 can be seen in the recessed area conforming to the exterior surface curvature of the flexible arm 140. As best seen in FIG. 8, the arm cover 144 traps the flat spring 142 and flexible arm 140 with fasteners 116 that run all the way to nuts 122 on the opposite side of the arm cover 144. As best seen in FIG. 9, the distal end of the flexible arm 140 includes a slot 170 to trap the other end of the flat spring 142.

Figure 11:
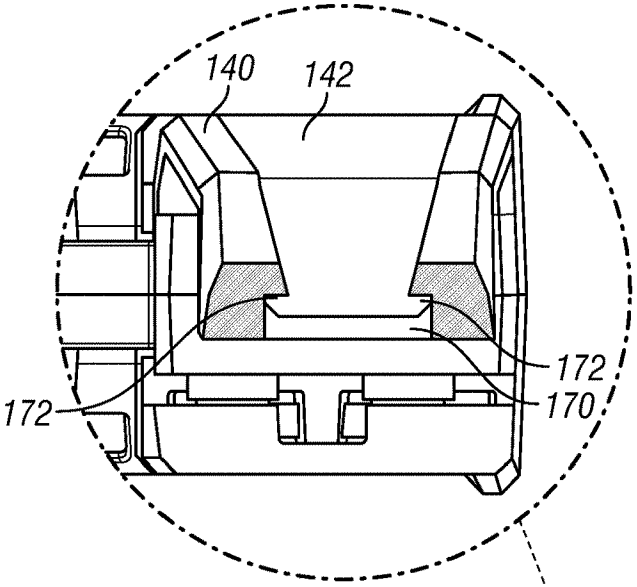
FIG. 11 is a detailed view showing the distal end of the spring shown in FIG. 10.
Figure 10:
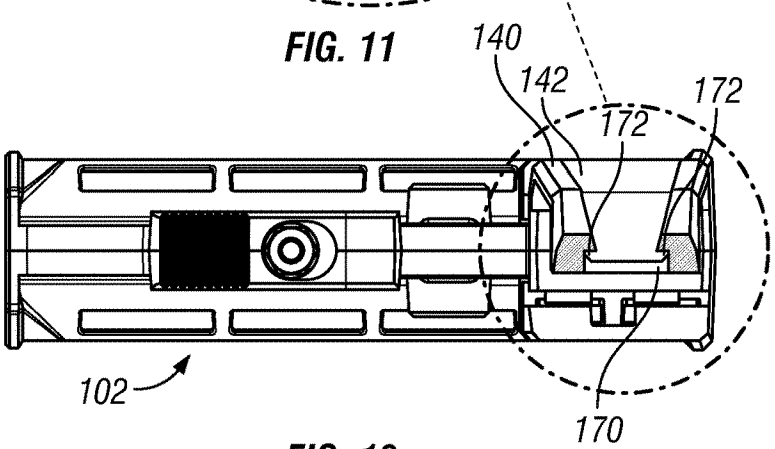
FIG. 10 is a bottom cross-sectional view of the example arm brace shown in FIG. 2 along line 10-10.

Referring now to FIGS. 10-11, there is shown the bottom of the pistol arm brace 100. From this view, the slot 170 for trapping the flat spring 142 can be seen. In the embodiment shown, the end of the flat spring 142 includes hooks 172 that retain the flat spring 142 in the slot 170.

Referring now to FIGS. 12-15, there is shown an embodiment in which the first spring-loaded arm 110 includes a flexible arm 140 that includes one or more alignment pockets 174 that are configured to receive one or more alignment lugs 176 in the flexible arm 140 of the second spring-loaded arm 112. The pockets 174 and lugs 176 keep the first spring-loaded arm 110 aligned with respect to the second spring-loaded arm 112. Also, the pockets 174 and lugs 176 increase rigidity between the first spring-loaded arm 110 and the second spring-loaded arm 112 when in the closed position.

Figure 17:
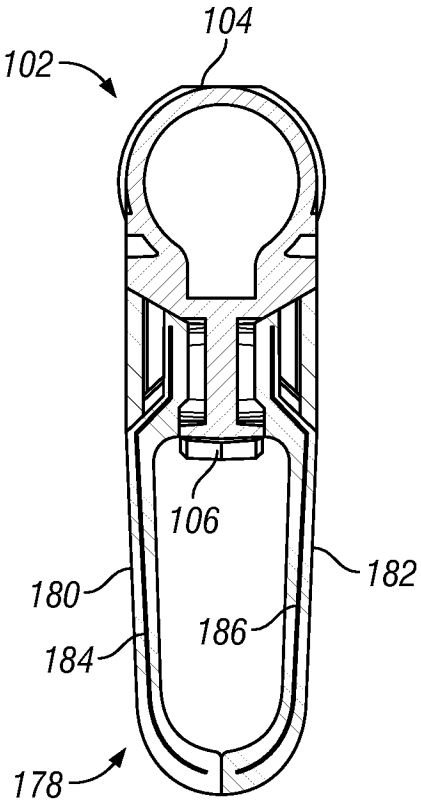
FIG. 17 is a rear cross-sectional view of the example arm brace shown in FIG. 16 along line 17-17.
Figure 16:
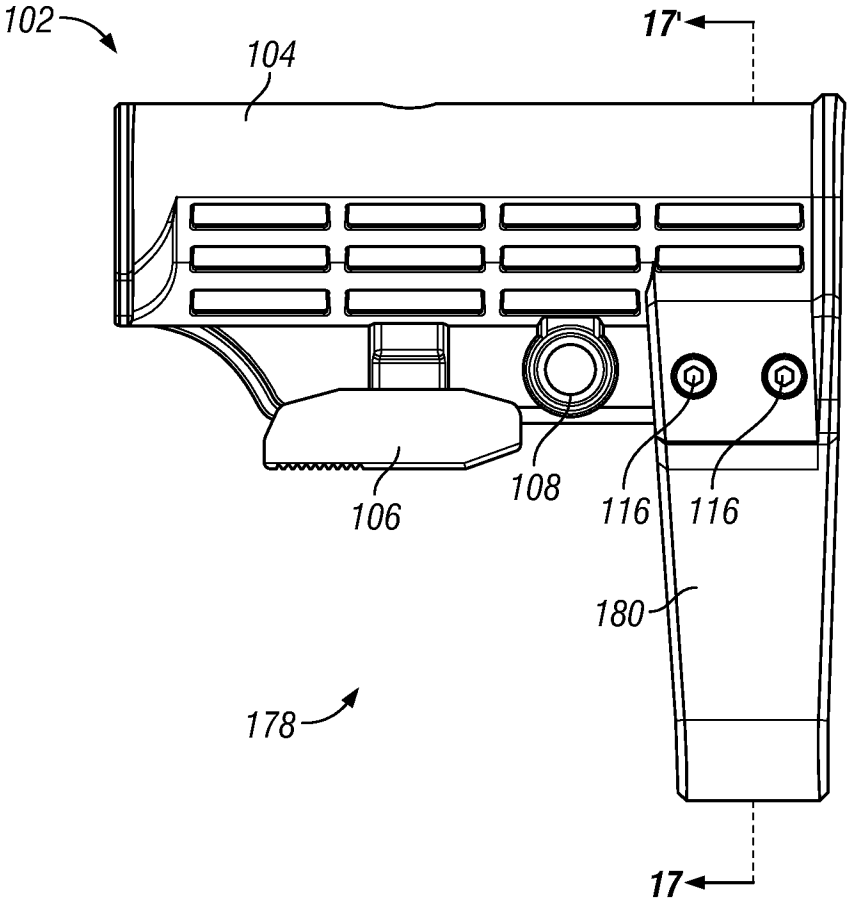
FIG. 16 is a left side view of an example arm brace according to an alternative embodiment of the disclosure.

FIGS. 16 and 17 illustrate a pistol arm brace 178 according to another embodiment. This embodiment is similar to the pistol arm brace 100, but includes flexible arms 180, 182 that completely encase the flat springs 184, 186. For example, the flat springs 184, 186 could be formed from stainless steel that is overmolded with a flexible material, such as rubber or silicon, to form the flexible arms 180, 182. In this manner, the pistol arm brace 178 includes spring-loaded arms similar to the pistol arm brace 100, but the flexible arms are molded over the flat springs instead of being separate components.

Figure 18:
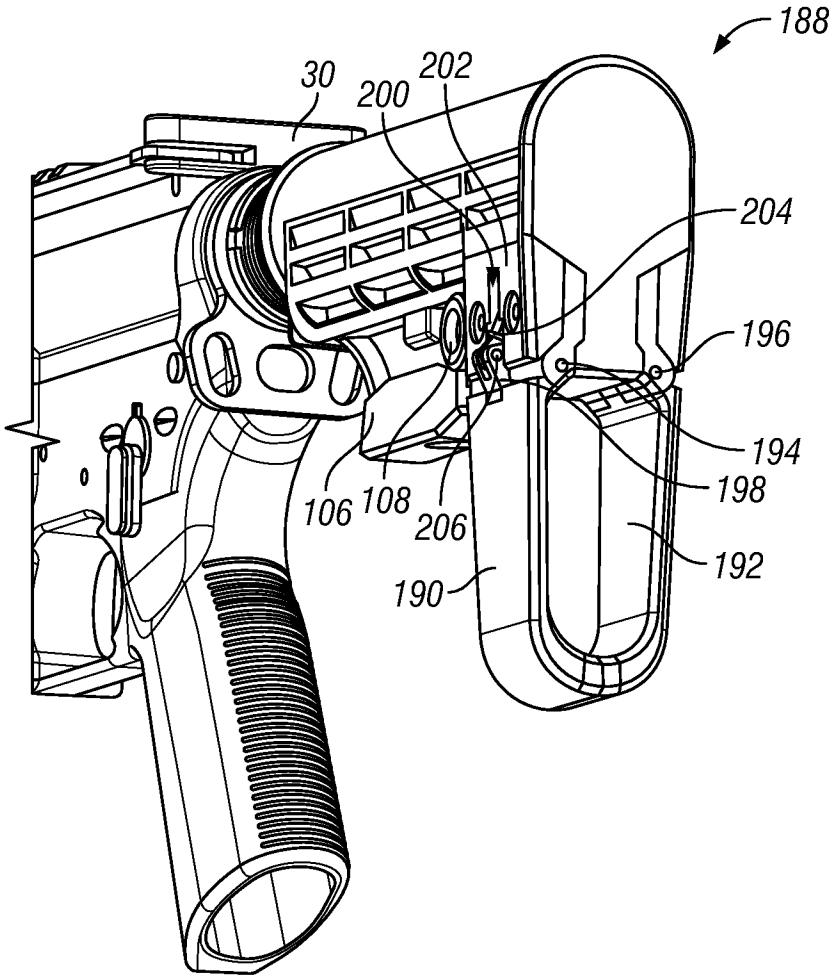
FIG. 18 is a left side perspective view of an example arm brace connected to a pistol according to an alternative embodiment of this disclosure with the arm brace in the storage position.
Figure 20:
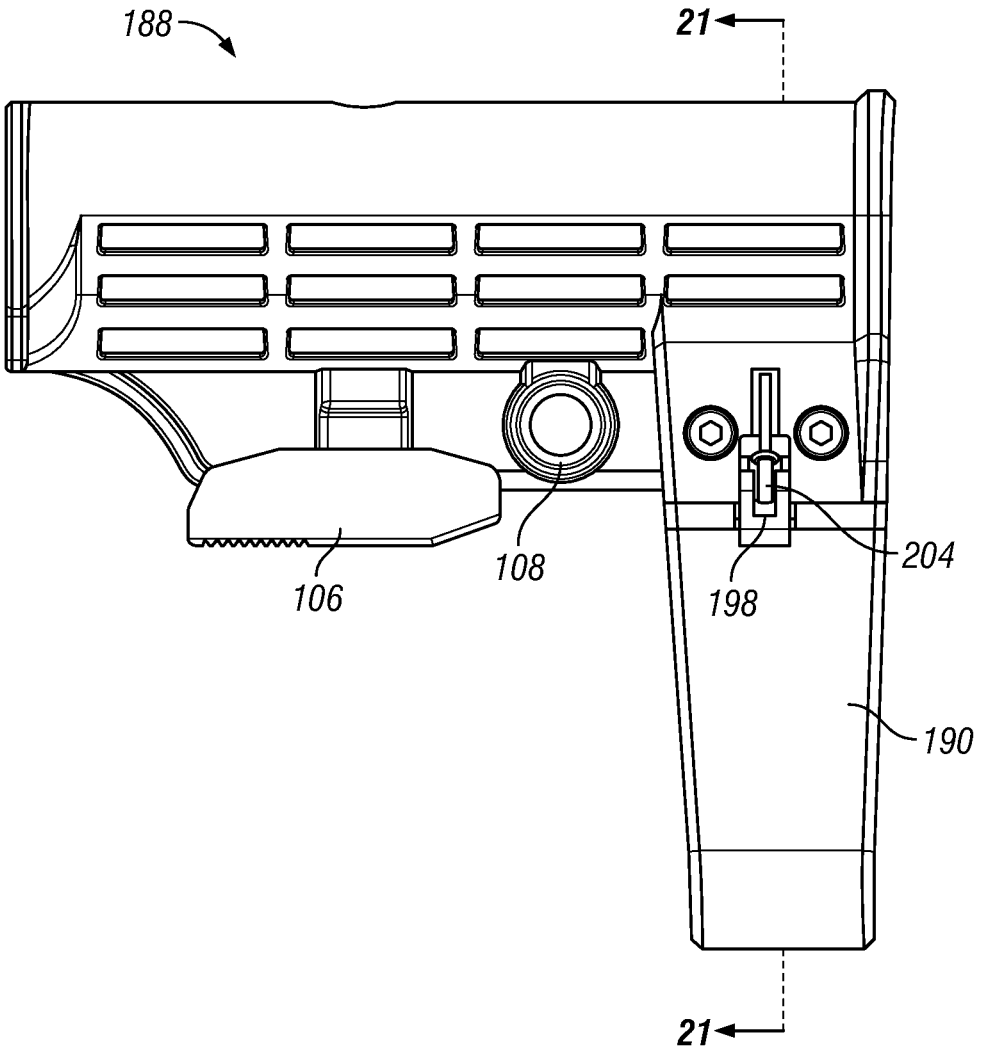
FIG. 20 is a left side view of the example arm brace shown in FIGS. 18-19.

FIGS. 18-24 illustrate a pistol arm brace 188 according to another embodiment. In this embodiment, the spring-loaded arms use compression springs instead of flat springs. In the embodiment shown, there is a first arm 190 and a second arm 192 that are movable between a closed position as shown in FIG. 18 and an open position shown in FIG. 19 in which the shooter's forearm extends through the opening. The arms 190, 192 are spring-loaded with compression springs to urge the arms 190, 192 towards the closed position, which provides tension to clamp the arms 190,192 around the shooter's forearm when in the open position. The arms 190, 192 may be formed from a variety of rigid materials, such as hard plastic, wood, metal, rubber overmolded with a rigid core, etc.

Figure 19:
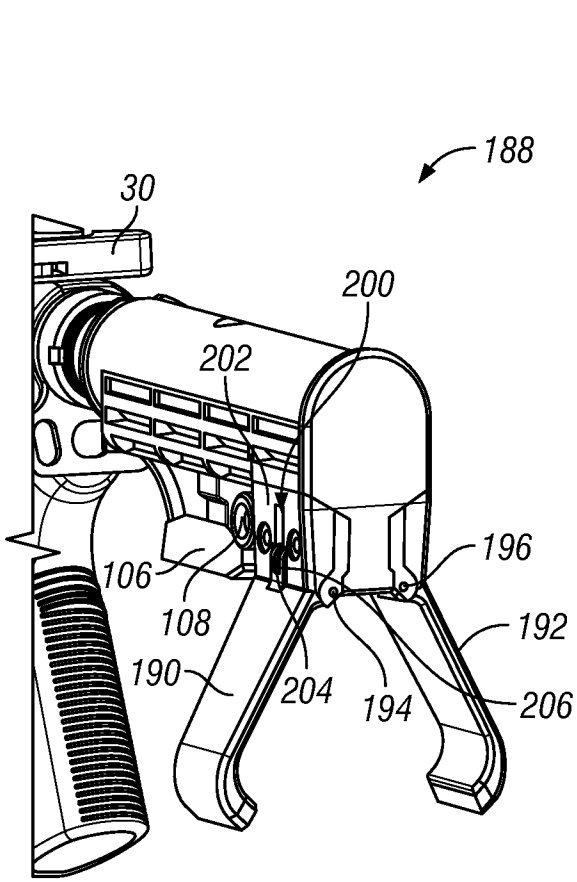
FIG. 19 is a left side perspective view of the example arm brace shown in FIG. 18 with the arms separated to illustrate positioning upon receiving a shooter's forearm.

In the embodiment shown, the first arm 190 pivots between the closed and open positions about a first pivot pin 194. Similarly, the second arm 192 pivots between the closed and open positions about a second pivot pin 196. As shown, the first arm 190 includes a first extension 198 that moves in and out of a first groove 200 in the first arm cover 202. In the example shown, the first extension 198 extends outside of the first groove 200 in the closed position (FIG. 18) and into the first groove 200 in the open position (FIG. 19). The first extension 198 is pivotally connected to a first spring-loaded pin 204 via a first spring pivot point 206. Accordingly, movement of the first extension 198 in and out of the groove 200 moves the position of the first spring pivot point 206 with respect to the first pivot point 194. The second arm 192 is spring-loaded in a similar manner to the first arm 190. For example, the second arm 192 may include a second extension 208 that moves in/out of a second groove 210 in a second arm cover 212. The second extension 208 is pivotally connected to a second spring-loaded pin 214 via a second spring pivot point 216 (See FIGS. 21-24).

Referring to FIGS. 21-24, a rear cross-sectional view of the pistol arm brace 188 reveals movement of the spring loaded pins 204, 214 as the arms 190, 192 move between open and closed positions. In the embodiment shown, there is a first internal passageway 218 and a second internal passageway 220 that captures a portion of the first spring-loaded pin 204 and the second spring-loaded pin 214, respectively. As shown, the first spring-loaded pin 204 and the second spring-loaded pin 214 extend further into the internal passageways 218, 220 when the arms 190, 192 are in the open position by overcoming urging of first compression spring 222 and second compression spring 224. The first compression spring 222 is captured between a flange 226 on the first spring-loaded pin 204 and an internal shoulder 228 and urges the first arm 190 towards the closed position. The second compression spring 224 is captured between a flange 230 on the second spring-loaded pin 214 and an internal shoulder 232 and urges the second arm 192 toward the closed position.

The position of the pivot points 206, 216 with respect to pivot pins 194, 196 are designed to allow a predetermined tension as the arms are extended by the shooter's forearm. For example, the position of the pivot pin 196 with respect to the pivot point 216 in FIG. 22 provides less leverage on the second arm 192 compared to the higher leverage position of the pivot point 216 with respect to the pivot pin 196 in FIG. 24. Accordingly, in this embodiment, the movement of the pivot points 206, 216 with respect to the pivot pins 194, 196 as the arms 190, 192 move between the open/closed position allows the tension to decrease as the arms 190, 192 are pivoted outward toward the open position shown in FIG. 23.

EXAMPLES

Illustrative examples of the pistol arm brace disclosed herein are provided below. An embodiment of the pistol arm brace may include any one or more, and any combination of, the examples described below.

Example 1 is a pistol arm brace with a slide portion and a stabilizing structure extending from the slide portion. The slide portion is configured to connect with a receiver extension of a pistol. The stabilizing structure includes a spring-loaded clamping portion configured to secure the stabilizing structure to a user's forearm based on urging of one or more springs in the spring-loaded clamping portion.

Example 2 includes the subject matter of Example 1, and wherein the spring-loaded clamping portion includes one or more springs configured to urge opposing walls towards each other to secure the stabilizing structure to the user's forearm.

Example 3 includes the subject matter of Examples 1-2, and wherein the one or more springs include one or more flat springs.

Example 4 includes the subject matter of Examples 1-3, and wherein the one or more springs include one or more compression springs.

Example 5 includes the subject matter of Examples 1-4, and wherein the opposing walls are formed, at least in part, from a flexible material.

Example 6 includes the subject matter of Examples 1-5, and wherein the opposing walls are formed from a flexible material overmolded over one or more springs.

Example 7 includes the subject matter of Examples 1-6, and wherein a first opposing wall includes a plurality of alignment pockets arranged to receive a plurality of alignment lugs on a second opposing wall.

Example 8 is a pistol arm brace with a brace body, a first spring-loaded arm, and a second spring-loaded arm. The brace body includes a slide portion configured to connect with a receiver extension of a pistol. The first spring-loaded arm is connected with the brace body. The second spring-loaded arm is connected with the brace body and opposes the first spring-loaded arm. The first spring-loaded arm and the second spring-loaded arm are movable between an open position and a closed position. In the open position, the first spring-loaded arm and the second spring-loaded arm are urged towards each other to clamp down on a user's forearm.

Example 9 includes the subject matter of Example 8, and wherein the first spring-loaded arm comprises a flexible portion operatively associated with a flat spring.

Example 10 includes the subject matter of Examples 8-9, and wherein the flexible portion defines a recessed portion to receive the flat spring.

Example 11 includes the subject matter of Examples 8-10, and wherein the flexible portion is an overmolding of the flat spring.

Example 12 includes the subject matter of Examples 8-11, and further comprising one or more fasteners extending transversely through the brace body to connect the first spring loaded arm and the second spring-loaded arm.

Example 13 includes the subject matter of Examples 8-12, and further comprising a pivot pin to pivotally connect the first spring-loaded arm to the brace body.

Example 14 includes the subject matter of Examples 8-13, and further comprising a spring-loaded pin pivotally connected with the first spring-loaded arm.

Example 15 includes the subject matter of Examples 8-14, and wherein the spring-loaded pin includes at least one compression spring.

Example 16 includes the subject matter of Examples 8-15, and wherein a position at least the spring-loaded pin pivots is movable as the first spring-loaded pin moves between the first position and the second position.

Example 17 is a pistol arm brace with a slide portion and a stabilizing structure. The slide portion is configured to connect with a receiver extension of a pistol. The stabilizing structure extends from the slide portion. The stabilizing structure includes strapless means for securing the stabilizing structure to a user's forearm.

Example 18 includes the subject matter of Example 17, and wherein the strapless means comprises a spring-loaded clamp.

Example 19 includes the subject matter of Examples 17-18, and wherein the spring-loaded clamp provides clamping tension with one or more flat springs.

Example 20 includes the subject matter of Examples 17-19, and wherein the spring-loaded clamp provides clamping tension with one or more compression springs.

The invention claimed is:

1. A pistol arm brace comprising:

a slide portion configured to connect with a pistol; and a stabilizing structure extending from the slide portion, wherein the stabilizing structure includes opposing stabilizing arms that are spaced apart to surround a user's forearm;

wherein the stabilizing structure is configured to urge the stabilizing arms towards each other to apply a clamping force to the user's forearm, thereby securing the stabilizing structure to the user's forearm; and wherein the stabilizing arms comprise one or more of: (1) a flexible arm attached with one or more springs; (2) a flexible material overmolded over one or more springs; or (3) a unitary member formed from an elastomeric material with a sufficient spring force to clamp down on the user's forearm without a supplementary strap to secure the stabilizing structure to the user's forearm.

2. The pistol arm brace of claim 1, wherein the one or more springs include one or more flat springs.

3. The pistol arm brace of claim 1, wherein the one or more springs include one or more compression springs.

4. The pistol arm brace of claim 1, wherein a first stabilizing arm includes at least one alignment pocket arranged to receive at least one alignment lug of a second stabilizing arm.

5. A pistol arm brace comprising:

a brace body including a slide portion configured to connect with a receiver extension of a pistol;

a first spring-loaded arm connected with the brace body;

a second spring-loaded arm connected with the brace body and opposing the first spring-loaded arm, wherein the first spring-loaded arm and the second spring-loaded arm are urged towards each other;

wherein the first spring-loaded arm and the second spring-loaded arm are movable between an open position in which the first spring-loaded arm and the second spring-loaded arm are spaced apart and a closed position in which at least a portion of the first spring-loaded arm and the second spring-loaded arm contact each other; and wherein the first spring-loaded arm comprises a flexible portion operatively associated with a flat spring and the flexible portion (i) defines a recessed portion to receive the flat spring or (ii) comprises an overmolding of the flat spring.

6. The pistol arm brace of claim 5, wherein the first spring-loaded arm comprises a flexible portion operatively associated with a flat spring.

7. The pistol arm brace of claim 5, further comprising one or more fasteners extending transversely through the brace body to connect the first spring loaded arm and the second spring-loaded arm.

8. The pistol arm brace of claim 5, further comprising a pivot pin to pivotally connect the first spring-loaded arm to the brace body.

9. A pistol arm brace comprising:

a brace body including a slide portion configured to connect with a receiver extension of a pistol;

a first spring-loaded arm connected with the brace body;

a second spring-loaded arm connected with the brace body and opposing the first spring-loaded arm, wherein the first spring-loaded arm and the second spring-loaded arm are urged towards each other;

wherein the first spring-loaded arm and the second spring-loaded arm are movable between an open position in which the first spring-loaded arm and the second spring-loaded arm are spaced apart and a closed position in which at least a portion of the first spring-loaded arm and the second spring-loaded arm contact each other; and a spring-loaded pin pivotally connected with the first spring-loaded arm.

10. The pistol arm brace of claim 9, wherein the spring-loaded pin includes at least one compression spring.

11. The pistol arm brace of claim 9, wherein a position at least the spring-loaded pin pivots is movable as the first spring-loaded arm moves between the open position and the closed position.

* * * * *